US008166925B2

(12) United States Patent
Suggett et al.

(10) Patent No.: US 8,166,925 B2
(45) Date of Patent: May 1, 2012

(54) METHOD AND APPARATUS FOR STEAM GENERATION

(75) Inventors: Jack C. Suggett, Calgary (CA); Michael J. Wasylyk, Bonnyville (CA)

(73) Assignee: FCCL Partnership, Calgary, Alberta (CA)

( * ) Notice: Subject to any disclaimer, the term of this patent is extended or adjusted under 35 U.S.C. 154(b) by 704 days.

(21) Appl. No.: 12/257,201

(22) Filed: Oct. 23, 2008

(65) Prior Publication Data

US 2009/0133643 A1 May 28, 2009

Related U.S. Application Data

(60) Provisional application No. 60/983,003, filed on Oct. 26, 2007.

(51) Int. Cl.
*F22D 5/36* (2006.01)

(52) U.S. Cl. ..... 122/451 S; 122/406.4

(58) Field of Classification Search ..... 122/1 B, 122/406.4, 451 S, 488, 489; 60/653, 679
See application file for complete search history.

(56) References Cited

U.S. PATENT DOCUMENTS 4,061,533 A * 12/1977 Durrant ..... 376/211
4,975,238 A * 12/1990 Regan et al. ..... 376/216
6,109,020 A * 8/2000 Liebig ..... 60/39.182
2007/0084418 A1* 4/2007 Gurevich ..... 122/1 B
2010/0193444 A1* 8/2010 Boodoo ..... 210/673

FOREIGN PATENT DOCUMENTS

CA 2621991 11/2008

* cited by examiner

*Primary Examiner* — Gregory A Wilson
(74) *Attorney, Agent, or Firm* — Haynes and Boone, LLP

(57) ABSTRACT

A method, apparatus, and system and operation of surface equipment to generate steam while reducing the quantity of boiler blowdown and thereby increasing the amount of feed-water that is re-used or re-cycled in generating said steam. The present invention teaches that, on a sustained basis, the blowdown stream at the outlet of a once-through steam generator can be routed to the inlet of a second once-through steam generator that is in series with the first, that blowdown stream can be used to generate additional steam in the second once-through steam generator and further reduce the amount of blowdown, and that this can be accomplished without need of any treatment that reduces hardness or silica levels of the blowdown stream prior to its entering or during its entry into the inlet of the second once-through steam generator. The output of this second steam generator is a substantially dry saturated steam vapor stream and, complementarily, a blow-down stream whose mass rate has been reduced substantially from that of the blowdown stream exiting the first steam generator.

31 Claims, 3 Drawing Sheets

METHOD AND APPARATUS FOR STEAM GENERATION

CROSS-REFERENCE TO RELATED APPLICATIONS

This application claims priority to and full benefit of U.S. provisional patent application No. 60/983,003, filed Oct. 26, 2007, the entirety of which is incorporated by reference herein.

FIELD OF THE INVENTION

The present invention relates generally to a method and apparatus for steam generation. More particularly, the present invention relates to a method and apparatus for reducing the amount of boiler blowdown that requires treatment and/or disposal.

BACKGROUND OF THE INVENTION

In this description, reference to steam-based thermal recovery operations or processes indicates that steam injection into a hydrocarbon reservoir is either an exclusive or a nonexclusive aspect of the injection portion of the process. When steam is a non-exclusive aspect of the recovery process, this implies that other substances may be co-injected or injected sequentially with the steam. Thus, by way of example, steam-based thermal recovery operations in which steam is a non-exclusive aspect of the injection stream can include such concurrent or sequential supplements to the injected steam as light liquid hydrocarbons, gaseous hydrocarbons such as natural gas, or non-hydrocarbon substances, such as nitrogen or air.

In steam-based thermal recovery operations that are typically aimed at recovering bitumen or heavy oil, a longstanding effective approach to raising steam has involved the use of once-through steam generators. Feedwater to the once-through steam generator (OTSG) can come from many sources and, depending upon the properties of the raw water, is treated to render it suitable as a feed stream for a OTSG. The steam thus generated is injected into an oil sand reservoir containing bitumen, or into a reservoir containing heavy oil. The steam heats and mobilizes the bitumen or heavy oil. When the mobile hydrocarbon liquid is lifted to the surface, it is part of a mixture that also contains water from condensed steam, formation water, and various minerals and other constituents which may be dissolved or suspended in the mixture, along with vapor and gaseous constituents.

After appropriate gas-liquid separation followed by treatment of the liquid stream to substantially segregate produced water from the produced liquid hydrocarbon constituent, current oilfield practice often involves some form of re-cycling of the produced water. This typically entails some form of treatment of the produced water that renders it suitable for re-use as boiler feedwater in the once-through steam generators. This treatment normally includes removal of hardness and reduction in silica levels.

It should be noted that a once-through steam generator is normally operated so that wet steam, typically around 80 percent quality, is generated, although other levels of steam quality may be selected. In some types of thermal recovery operation, the entire stream of wet steam is injected into the reservoir, for example Cyclic Steam Stimulation (CSS). In other types of thermal recovery operations, such as those involving Steam Assisted Gravity Drainage (SAGD), the wet steam is first separated into its vapor and liquid components by means of a steam separator at the outlet of the once-through steam generator. The vapor component exiting the steam separator, consisting of substantially 100 percent quality steam, also known as dry saturated steam, is injected into the reservoir. However, the liquid component, referred to as blowdown contains in concentrated form essentially all of the impurities that were originally in the feedwater.

The blowdown, with its high impurity levels, may be disposed of, often after some form of heat exchange, or may be re-routed back to the inlet of the water treatment facility where it is treated and re-used. Alternatively, the blowdown may be routed to some other appropriate point in the process that is upstream of the once-through steam generator.

Under current industry practice, re-cycling of blowdown by re-routing it from the outlet of the steam generator back to the inlet of the water treatment facility is often an acceptable approach. The more blowdown that can be utilized in this way, the less the need for make-up water from some higher quality source. However, a disadvantage of this approach is that the size of the water treatment facility has to be enlarged to accommodate the blowdown stream, and the operation has to be adjusted accordingly, thereby incurring additional capital and operating costs. Also, in some circumstances, the levels of Total Dissolved Solids in the blowdown stream limit the amount of blowdown that can be re-cycled to the water treatment facility.

Analogously, an evaporator may be employed upstream of the once-through steam generator when using produced water to generate steam. The blowdown from the once-through steam generator can be routed back to the evaporator inlet or feed tank for recycling through the evaporator. Evaporators are energy intensive and are therefore not always a desirable alternative. However, if one were to choose an evaporator for this service, the facilities would need to be sized and designed to accommodate the re-cycled stream. Also, as the evaporator operates at essentially atmospheric conditions, some irreversible energy loss would be incurred when the high pressure blowdown from the once-through steam generator is routed to the evaporator inlet or feed tank.

A further alternative involves treatment of the boiler blowdown. This treatment can include chemical means to reduce hardness and silica, or can involve physical means such as evaporation. However, this is a costly alternative.

It is, therefore, desirable to provide an improved method and apparatus for steam generation that provides improved handling of boiler blowdown.

SUMMARY OF THE INVENTION

It is an object of the present invention to obviate or mitigate at least one disadvantage of previous apparatus and method for generating steam and processing boiler blowdown.

A method, apparatus, and system and operation of surface equipment to generate steam while reducing the quantity of boiler blowdown and thereby increasing the amount of feedwater that is re-used or re-cycled in generating said steam. The present invention teaches that, on a sustained basis, the blowdown stream at the outlet of a once-through steam generator can be routed to the inlet of a second once-through steam generator that is in series with the first, that blowdown stream can be used to generate additional steam in the second once-through steam generator and further reduce the amount of blowdown, and that this can be accomplished without need of any treatment that reduces hardness or silica levels of the blowdown stream prior to its entering or during its entry into the inlet of the second once-through steam generator. The output of this second steam generator is a substantially dry saturated steam vapor stream and, complementarily, a blowdown stream whose mass rate has been reduced substantially from that of the blowdown stream exiting the first steam generator.

The present invention adopts a principle that is not practiced in the industry, inter alia, because it is not considered workable or advisable on a sustained basis, but which has been reduced to practice in the course of developing the present invention and determined to be useful and advantageous. Adoption of this principle permits the utilization of an equipment configuration and an associated process that is not used within industry, and that is simpler and less expensive than the current alternatives. In addition, the present invention reduces environmental impact through reduced use of chemicals and reduced consumption of energy, as well as reduced volumes of disposal of water.

The present invention pertains to a process involving once-through steam generators. When referring to a once-through generator in the context of the present invention, we are also including the steam separator at the outlet of said once-through generator which separates the wet steam into a dry saturated steam phase and a blowdown stream. The present invention teaches that, in the case of steam-based in situ recovery operations that involve re-use of produced water, the blowdown from a once-through steam generator need not be subject to treatment that reduces or removes hardness and silica prior to its being re-used. Instead, in accordance with the teachings of the present invention, the blowdown from a first once-through steam generator is routed directly, and without any treatment that removes or reduces hardness or silica, into the inlet of a second once-through steam generator that is placed in series with and downstream of the first once-through steam generator. Thus the blowdown from the first once-through steam generator serves as the feed water to the second once-through steam generator. The output of this second steam generator is a steam vapor stream that can be utilized in the steam-based recovery process, and a reduced volume of blowdown component when compared with that which constituted the feedwater stream.

An important aspect of the present invention is that the process of the invention, and specifically the absence of a need for hardness removal or silica reduction in the feed stream to the second once-through steam generator, occurs on a sustained basis, in contrast with processes where a temporary or momentary anomaly or excursion in feed water quality may occur.

In view of the high concentrations of impurities in the blowdown water that constitutes the feed stream to the second steam generator, the present invention teaches a principle and describes a practice that is contrary to all current industry guidelines and is not embodied in industry practice. However, experimentation reveals that this configuration is workable and practical on a sustained basis, and that the expected risk of rapid fouling of the tubes in the second steam generator due to the introduction of blowdown water without any prior treatment that removes or reduces hardness or silica levels does not occur.

Based on the principles taught by the present invention, the configuration and operation of the present invention can be expanded from the configuration and operation described above, in which two once-through steam generators are placed in series with the blowdown stream from the first serving as the feed stream to the second without any intervening reduction in hardness or silica, to an analogous configuration in which more than two once-through steam generators are placed in series in this manner.

Also, based on the principle taught by the present invention, in place of a single once-through steam generator, the present invention can utilize a bank or parallel configuration of two or more once-through steam generators. The replacement of a single once-through steam generator by a bank or parallel configuration of once-through steam generators can occur at any of the stages that constitute the multiplicity of sequentially arranged once-through steam generators.

In a first aspect, the present invention provides a method of producing steam including providing a once-through steam generator, the once-through steam generator providing wet steam from a water supply, providing a steam separator, the steam separator receiving the wet steam from the once-through steam generator and separating it into substantially boiler blowdown and substantially saturated steam, providing a blowdown boiler, the blowdown boiler providing wet steam from the boiler blowdown, and providing a steam separator, the steam separator receiving the wet steam from the blowdown boiler and separating it into substantially blowdown boiler blowdown and substantially saturated steam.

In a further aspect, the present invention provides a method of reducing the quantity of boiler blowdown requiring treatment or disposal including providing boiler blowdown from a steam generator, providing a blowdown boiler, the blowdown boiler providing wet steam from the boiler blowdown, providing a steam separator, the steam separator receiving the wet steam from the blowdown boiler and separating it into substantially blowdown boiler blowdown and substantially saturated steam, and treating or disposing of the blowdown boiler blowdown, the quantity of the blowdown boiler blowdown being less than the quantity of boiler blowdown.

In a further aspect, the present invention provides an apparatus/system for generating steam including a once-through steam generator, the once-through steam generator adapted to produce wet steam from a water supply, a steam separator, the steam separator adapted to receive the wet steam from the once-through steam generator and separate it into substantially boiler blowdown and substantially saturated steam, a blowdown boiler, blowdown boiler adapted to provide wet steam from the boiler blowdown, and a steam separator, the steam separator adapted to receive the wet steam and separate it into substantially blowdown boiler blowdown and substantially saturated steam.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method, apparatus, and system for steam generation.

Figure 1:
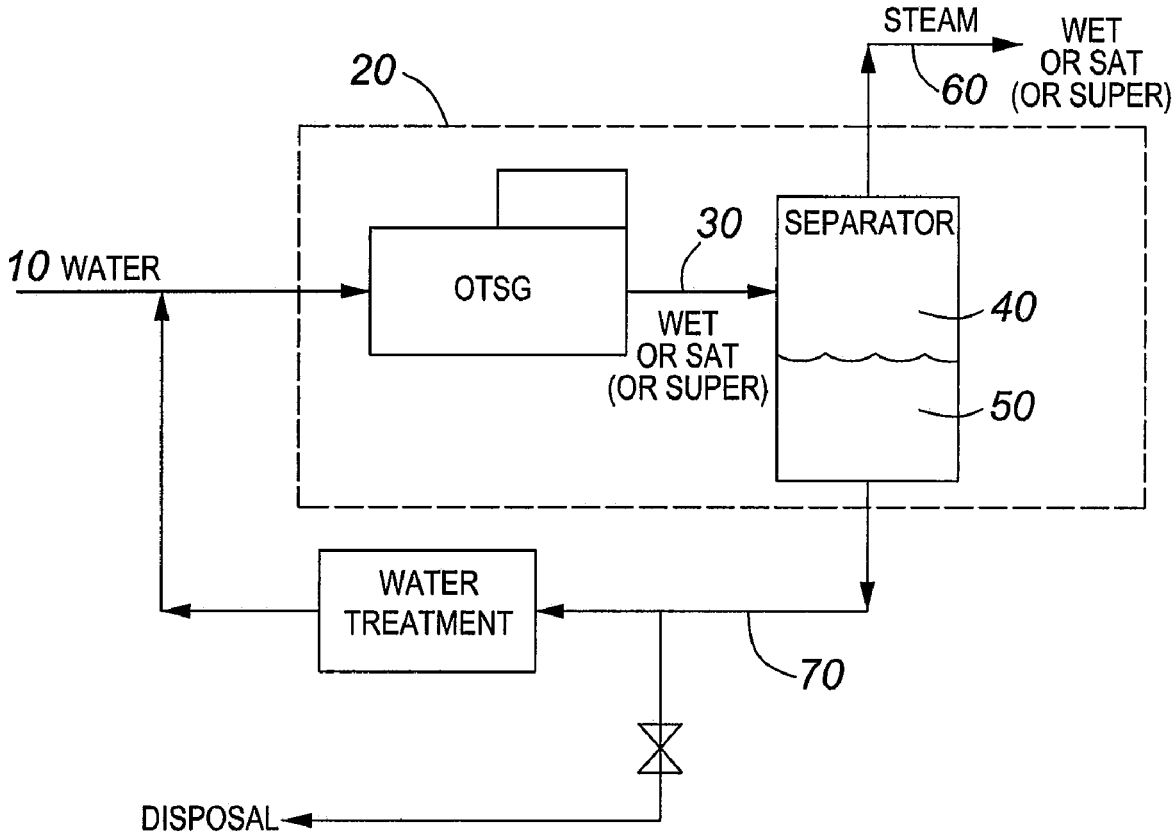
(PRIOR ART) FIG. 1
FIG. 1 is a simplified schematic of a prior art steam generator.

Referring to FIG. 1, a water source 10 for example, water produced from in situ recovery operations is provided to a once-through steam generator (OTSG) 20 and OTSG 20 produces a wet steam output 30. A steam separator 40 separates any boiler blowdown (boiler blowdown) 50 and a substantially saturated steam supply 60 is provided for use. A boiler blowdown stream 70, carrying contaminants, is sent to disposal or water treatment.

Figure 2:
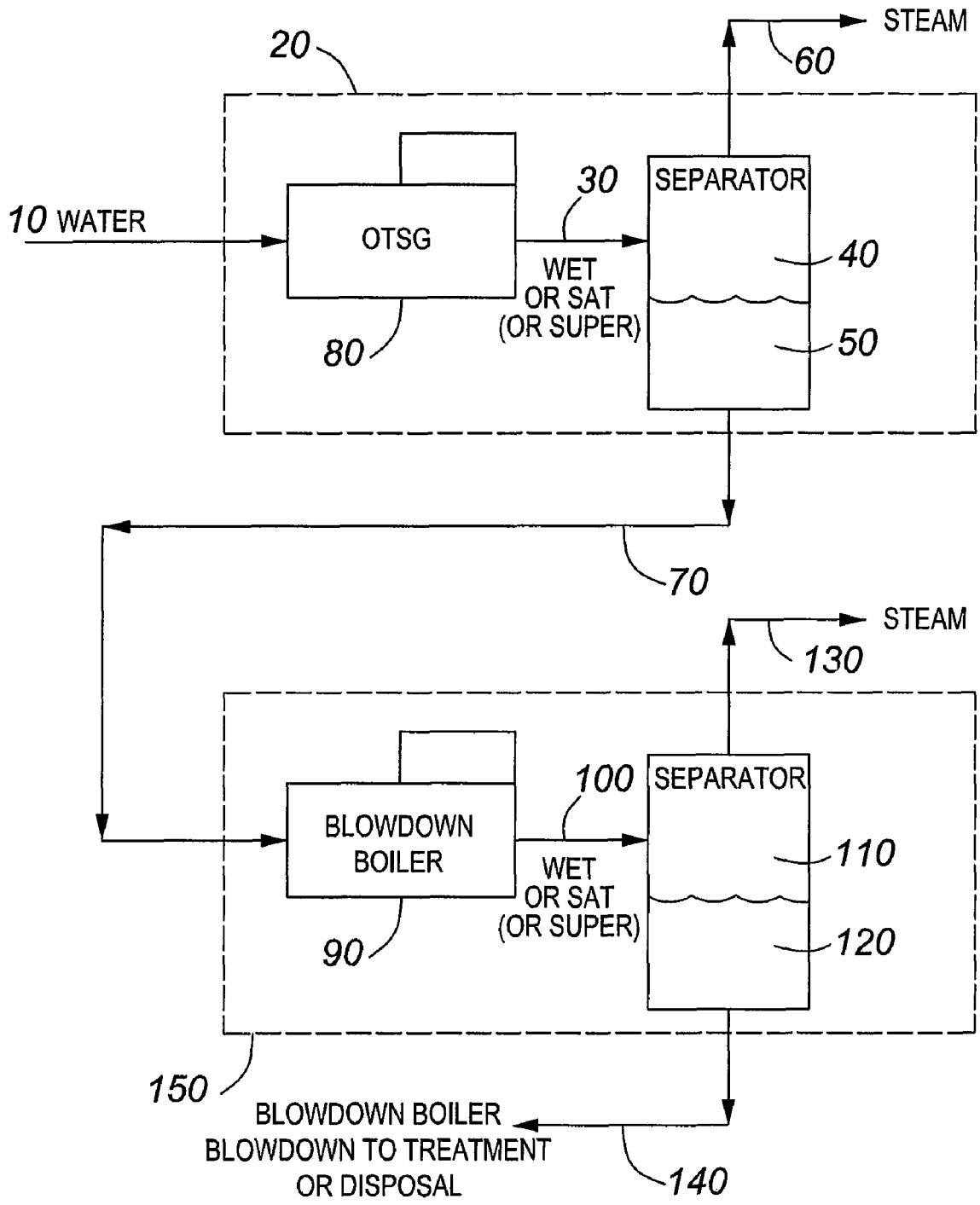
FIG. 2 is a simplified schematic of a system of the present invention.

Referring to FIG. 2, a once-through steam generator 20 produces a wet steam output 30. A steam separator 40 separates boiler blowdown 50 and a substantially saturated steam supply 60 is provided for use. A boiler blowdown stream 70 carrying boiler blowdown 50 is provided to a blowdown boiler 90 which produces a wet blowdown steam output 100. The boiler blowdown 50 is delivered to the blowdown boiler 90 in an untreated state. As an example, the boiler blowdown 50 is not routed through a water treatment plant to remove hardness or silica. The boiler blowdown 50 may optionally be passed through heat exchangers to add or recover heat and make up water may optionally be added to the boiler blowdown 50. A blowdown steam separator 110 separates any blowdown boiler blowdown 120 and a substantially saturated blowdown steam supply 130 is provided for use. The blowdown steam supply 130 and the steam supply 60 may be combined. A blowdown boiler blowdown stream 140, carrying contaminants, is sent to disposal or water treatment. The blowdown boiler 90 may be sized similarly to that of the once-through steam generator 20 or may have a capacity that is larger or greater than the once-through steam generator 20.

Figure 3:
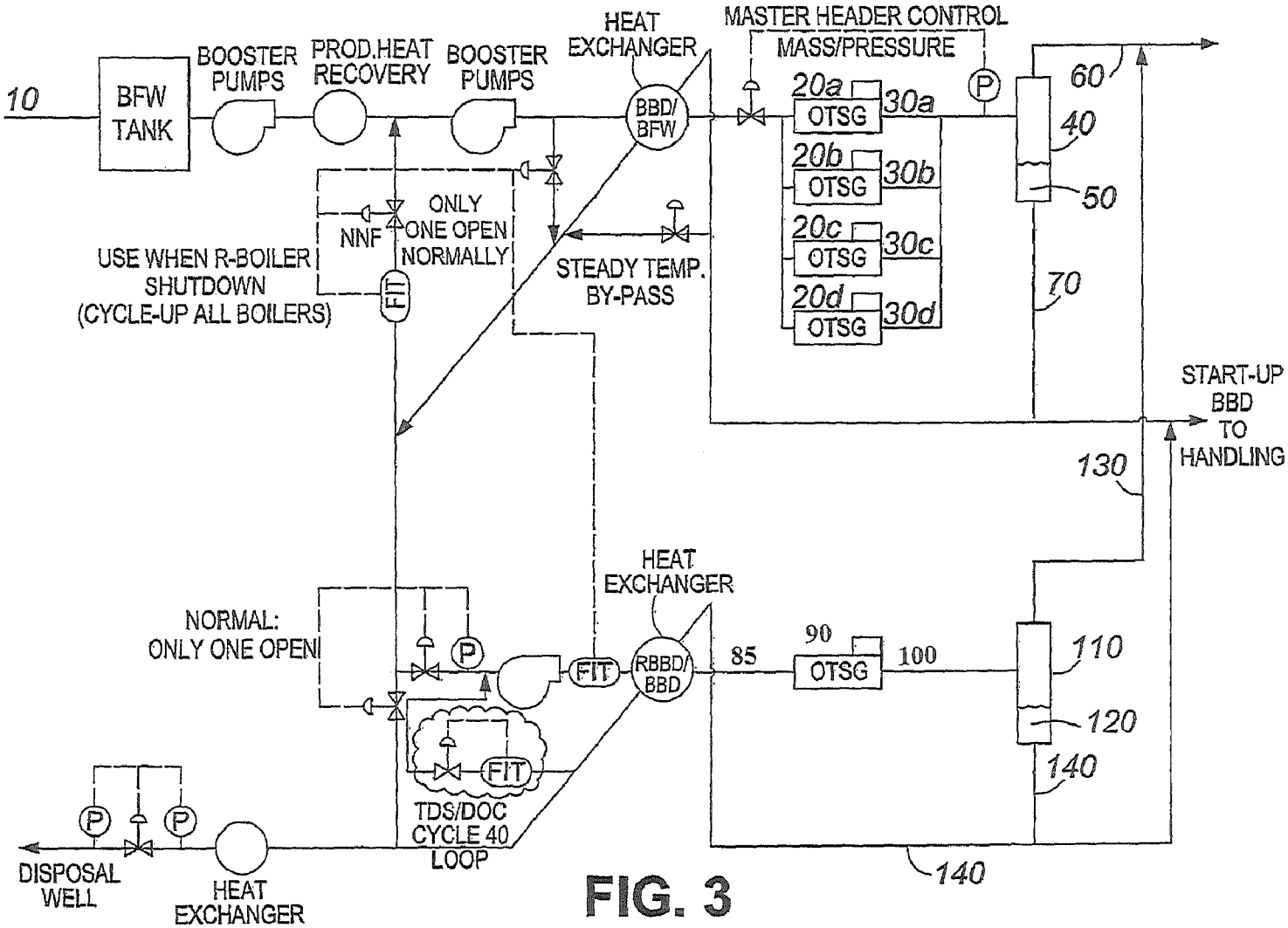
FIG. 3 is a simplified schematic of a system of the present invention.

Referring to FIG. 3, one or more once-through steam generators may be arranged in parallel, such as once-through steam generators 20*a*, 20*b*, 20*c*, 20*d* etc. each producing a wet steam supply 30*a*, 30*b*, 30*c*, 30*d* etc. respectively which may be combined into wet steam supply 35.

The boiler blowdown 50 from the steam separator 40 may be carried by boiler blowdown stream 70 to the water supply 10 upstream of the once-through steam generators 20*a*, 20*b*, 20*c*, 20*d* etc. To improve operational flexibility, a portion of the boiler blowdown stream 70 may be routed to disposal or water treatment on an intermittent or continuous basis. In this mode of operation, the once-through steam generators are fed a stream of water containing recycled boiler blowdown (that is, boiler blowdown stream 70). From time to time, as necessary, any once-through steam generator 20*a*, 20*b*, 20*c*, 20*d* may be isolated/bypassed from the water/steam flow for maintenance or inspection. Boiler blowdown stream 70 may contain a significant amount of contaminants (remnant from the water supply 10).

Alternatively, the boiler blowdown 50 from the steam separator 40 may be carried by boiler blowdown stream 70 as blowdown boiler feed 85 to the blowdown boiler 90 which produces a wet blowdown steam output 100. A blowdown steam separator 110 separates any blowdown boiler blowdown 120 and a substantially saturated blowdown steam supply 130 is provided for use. The blowdown steam supply 130 and the steam supply 60 may be combined. A blowdown boiler blowdown stream 140, carrying contaminants (for example, remnant from the boiler blowdown stream 70), is sent to disposal or water treatment. Blowdown boiler 90 is preferably an once-through steam generator. The blowdown boiler feed 85 may contain a significant amount of contaminants (remnant from the water supply 10), and may contain contaminants exceeding the normal or recommended operating guidelines or parameters of the blowdown boiler 90. Water from the water supply 10 may be added to the blowdown boiler feed 85.

In this operating condition, the blowdown boiler 90 is primarily fed a stream of water containing recycled boiler blowdown. From time to time, as necessary, blowdown boiler 90 may be isolated/bypassed from the water/steam flow for maintenance or inspection. In the event that blowdown boiler 90 is isolated/bypassed from the water/steam flow for maintenance or inspection, the boiler blowdown 70 may be routed upstream of the once-through steam generator 20*a*, 20*b*, 20*c*, 20*d* etc. or routed to disposal or water treatment.

In the preceding description, the steam generation has been described by a once-through steam generator. One skilled in the art recognizes that the invention is also applicable to other types of boilers. In addition, a once-through steam generator could be replaced with a series of heat exchangers/boilers to accomplish the heating of water and phase changes from liquid to liquid/vapour or vapour.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A system for use in generating steam, the system comprising:

a primary steam generation unit comprising:

at least one once-through steam generator (OTSG) for receiving system infeed water from a system water supply and converting said system infeed water to wet steam, and a steam separator for receiving the wet steam from the OTSG and separating it into a first steam output and a blowdown stream; and a secondary steam generation unit comprising at least one once-through steam generator (OTSG) connected in series with said steam separator, for receiving the blowdown stream and generating a second wet stream output.

2. The system as in claim 1 wherein the primary steam generation unit comprises a bank of OTSGs connected in parallel.

3. The system as in claim 2, wherein the primary steam generation unit comprises an independent flowpath associated with each OTSG for directing infeed water independently to each OTSG.

4. The system as in claim 2, wherein at least one OTSG receives infeed water from an independent water supply.

5. The system as in claim 1, wherein the secondary steam generation unit comprises a bank of OTSGs connected in parallel.

6. The system as in claim 5, wherein the secondary steam generation unit comprises an independent flowpath associated with each OTSG for directing infeed water independently to each OTSG of the secondary steam generation unit.

7. The system as in claim 1, wherein the system further comprises a system infeed water line to the secondary steam generation unit.

8. The system as in claim 1, further comprising a bypass for use in routing blowdown from said first or second steam generation unit stream to the system infeed water or to the system water supply.

9. The system as in claim 1, wherein the second steam output is combined with the first steam output.

10. The system as in claim 9 wherein the second steam output is separated to dry steam and blowdown.

11. The system as in claim 9, wherein the second steam generation unit further comprises a separator, and wherein the second steam output comprises a secondary dry steam output and a second blowdown stream.

12. The system as in claim 1, wherein each steam generation unit comprises a OTSG and a steam separator, each steam separator for receiving wet steam produced by a corresponding OTSG and separating the wet steam into a boiler blowdown stream and a saturated steam stream.

13. The system as claim 1, further comprising a heat exchanger for use in transferring heat between the boiler blowdown stream and system infeed water.

14. The system as in claim 1, wherein the system infeed water has been rendered suitable for use as an OTSG feed stream.

15. A method for increasing steam production from a steam generator system, the method comprising the steps of:

providing infeed water to a first steam generation unit, the first steam generation unit comprising an OTSG and a steam separator connected in series, the steam generation unit operable to generate steam and blowdown from the infeed water;

recovering blowdown water from the first steam generation unit; and using said blowdown water, free of substantial pre-treatment as a primary infeed to a second steam generation unit, wherein the second steam generation unit comprises an OTSG.

16. The method as in claim 15, wherein the first or second steam generation unit comprises a bank of OTSGs connected in parallel.

17. The method as in claim 15, wherein the water quality of the blowdown water would otherwise be considered unsuitable for use as infeed water for an OTSG.

18. The method as in claim 15, wherein the infeed water has been rendered suitable for use as a feed stream for a OTSG.

19. The method as in claim 15, further comprising the step of adding make up water to the blowdown water prior to feeding the blowdown water to the second steam generation unit.

20. The method as in claim 19, wherein the make up water is a further amount of system infeed water.

21. The method as in claim 15, further comprising the step of exchanging heat between the blowdown water and infeed water.

22. The method as in claim 15, further comprising providing a backup OTSG connected in parallel to the first or second steam generation unit.

23. The method as in claim 22, wherein infeed water is provided to each OTSG independently to facilitate bypass of any one OTSG for maintenance without compromising operation of steam production.

24. The method as in claim 22, further comprising the step of isolating a OTSG from the steam generation unit for maintenance.

25. The method as claim 15, wherein the blowdown water contains the concentrated contaminants present in the infeed water.

26. The method as in claim 15, further comprising the step of recovering steam from each of the first and second steam generation units and combining them in a common steam output.

27. The method as in claim 26, wherein the steam output is wet steam, dry steam, saturated steam, or superheated steam.

28. A system for generating steam from blowdown water, the system comprising:

a steam generation unit comprising a set of one or more OTSGs, the set comprising either one OTSG or a plurality of OTSGs connected in parallel;

a source of OTSG blowdown water for use as infeed water to the steam generation unit; and a series of conduits for controlling flow of said infeed water to each OTSG in the set.

29. The system as in claim 28, wherein the source of OTSG blowdown water is a source steam generation unit comprising a source OTSG and a source steam separator, and wherein the blowdown is not treated prior to use as infeed water.

30. The system as in claim 29, wherein the blowdown water contains concentrated contaminants.

31. The system as in claim 28, wherein a volume of make up water is added to the blowdown prior to use as infeed water for the steam generation unit.

* * * * *